US007436381B2

(12) United States Patent
Kim et al.

(10) Patent No.: US 7,436,381 B2
(45) Date of Patent: Oct. 14, 2008

(54) SOURCE LINE REPAIR CIRCUIT, SOURCE DRIVER CIRCUIT, LIQUID CRYSTAL DISPLAY DEVICE WITH SOURCE LINE REPAIR FUNCTION, AND METHOD OF REPAIRING SOURCE LINE

(75) Inventors: Kyung-Myun Kim, Seoul (KR); Chang-Hwe Choi, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 727 days.

(21) Appl. No.: 10/966,274

(22) Filed: Oct. 15, 2004

(65) Prior Publication Data

US 2005/0110738 A1 May 26, 2005

(30) Foreign Application Priority Data

Nov. 20, 2003 (KR) ..... 10-2003-0082620

(51) Int. Cl.
*G09G 3/36* (2006.01)

(52) U.S. Cl. ..... 345/87; 345/904; 349/54

(58) Field of Classification Search ..... 345/205, 345/204, 93, 87, 904, 98, 100, 209; 349/54, 349/192

See application file for complete search history.

(56) References Cited

U.S. PATENT DOCUMENTS 5,859,627 A * 1/1999 Hoshiya et al. ..... 345/93
6,373,459 B1 * 4/2002 Jeong ..... 345/204
6,407,729 B1 * 6/2002 Moon ..... 345/205
6,522,323 B1 * 2/2003 Sasaki et al. ..... 345/204
6,525,705 B1 * 2/2003 Ishii et al. ..... 345/93
6,970,274 B2 * 11/2005 Morita et al. ..... 345/205
2003/0103045 A1 * 6/2003 Shiraishi ..... 345/204
2003/0117353 A1 * 6/2003 Moon ..... 345/87

FOREIGN PATENT DOCUMENTS

JP 2002-321599 11/2000
JP 2002-023712 1/2002

* cited by examiner

*Primary Examiner*—Chanh Nguyen
*Assistant Examiner*—Adam J Snyder
(74) *Attorney, Agent, or Firm*—Mills & Onello, LLP

(57) ABSTRACT

A source driver circuit provides a source driving signal to a disconnected source line. The source driver circuit includes a shift register, a latch unit, a DAC unit, a buffer unit, and a source line repair circuit. A source line repair circuit receives a common voltage signal and a source driving signal corresponding to the disconnected source line, selects an amplifier having a same polarity type as a polarity type of an amplifier constituting the buffer unit in response to a source driving signal to provide an output signal of the selected amplifier to the disconnected source line. The source driver circuit includes the source line repair circuit which may select the amplifier having the same polarity as the polarity of the amplifier of the buffer, and thus may safely provide the source driving signal to the disconnected source line.

19 Claims, 11 Drawing Sheets

SOURCE LINE REPAIR CIRCUIT, SOURCE DRIVER CIRCUIT, LIQUID CRYSTAL DISPLAY DEVICE WITH SOURCE LINE REPAIR FUNCTION, AND METHOD OF REPAIRING SOURCE LINE

CLAIM FOR PRIORITY

This application claims priority to Korean Patent Application No. 2003-82620 filed on Nov. 20, 2003 in the Korean Intellectual Property Office (KIPO), the entire contents of which are hereby incorporated by reference.

BACKGROUND OF THE INVENTION

1. Field of the Invention

The present invention relates to a source driver circuit of a display device.

2. Description of the Related Art

An LCD device is thinner and lighter than a Cathode Ray Tube (CRT), and is widely used for an information processing device since the quality of the LCD device is gradually enhanced.

An active matrix LCD device has a plurality of active elements that are respectively connected to plural pixel electrodes arranged in a matrix. An active matrix LCD device has a contrast ratio higher than that of a passive matrix LCD device. As a result, an active matrix driver is commonly used for a color LCD device.

The TFT (Thin Film Transistor) is widely used as an active element connected to each pixel electrode of an active matrix LCD device. FIG. 1 is a block diagram showing a conventional active matrix LCD device disclosed in U.S. Pat. No. 6,407,729.

Referring to FIG. 1, the controller 100 receives video data and control signals, and outputs control signals SCON to the gate driver unit 140 and gray scale data DATA to the source driver 1000.

A power supply unit 110 receives an external power source, and generates a stable DC voltage to provide the stable DC voltage to the controller 100, a gray scale voltage generator 120, and a gate voltage generator 130. The gray scale voltage generator 120 provides a reference gray scale voltage VGR to the source driver 1000. The gate voltage generator 130 generates a turn-on voltage and a turn-off voltage to provide the turn-on and turn-off voltages to the gate driver 140.

The gate driver 140 and source driver 1000 include a plurality of gate driver ICs and a plurality of source driver ICs, respectively. The gray scale data 'DATA' determine a gray scale level for each of the pixels. The gate driver 140 receives control signals SCON from the controller 100, and the source driver 1000 receives the gray scale data 'DATA' from the controller 100.

The source driver 1000 supplies a liquid crystal panel 150 with a plurality of source driving signals, and the gate driver 140 supplies the liquid crystal panel 150 with a plurality of gate signals. The liquid crystal panel 150 has a plurality of TFTs (Thin Film Transistors) located in matrices of the panel 150. A source of the TFT receives one of the source driving signals, and a gate of the TFT receives one of the gate signals. The TFT has a storage capacitor $C^s$ and a liquid crystal capacitor $C_{LC}$ coupled to a drain of the TFT.

In the event that one of the source lines of the liquid crystal panel 150 is disconnected, the entire panel may not operate normally since the source driving signal is not transmitted to a source line disconnected from the source driver IC. When one or two disconnected source lines of the display panel 150 are considered to be a failed source line, the production yield of the LCD panels may be significantly lowered.

SUMMARY OF THE INVENTION

Accordingly, the present invention is provided to substantially obviate one or more problems due to limitations and disadvantages of the related art.

It is a first feature of the present invention to provide a source line repair circuit for supplying a source driving signal to a one end of a disconnected source line of a liquid crystal display panel.

It is a second feature of the present invention to provide a source driver circuit of an LCD device having the source line repair circuit.

It is a third feature of the present invention to provide an LCD device having the source line repair circuit.

It is a fourth feature of the present invention to provide a source line repair method for repairing the disconnected source lines.

In accordance with a first aspect, the invention is directed to a source line repair circuit. The source line repair circuit of the invention includes a comparator configured to compare a source driving signal with a common voltage signal to output a selection signal. The source driving signal corresponds to a disconnected source line of a liquid crystal display device. The selection signal has a first level when the source driving signal is higher than the common voltage signal, and the selection signal has a second level when the source driving signal is lower than the common voltage signal. An amplifying circuit is configured to amplify the source driving signal to output a first amplified signal and a second amplified signal. A selection circuit is configured to select one of the first and second amplified signals in response to the selection signal to output the selected amplified signal to the disconnected source line.

For example, a comparator receives source driving signals and common voltage signals corresponding to the disconnected source line of an LCD device, compares the source driving signals with common voltage signals, and outputs a selection signal to the selection circuit in response to the source driving signal.

An amplifying circuit receives source driving signals and when a source driving signal is higher than common voltage signal, the amplifying circuit amplifies the source driving signal and outputs the first amplified signal to the selection circuit, and when the source driving signal is lower than common voltage signal, the amplifying circuit amplifies the source driving signal and outputs the second amplified signal to the selection circuit.

In accordance with one embodiment, the amplifying circuit has a positive polarity amplifier and a negative polarity amplifier. The positive polarity amplifier receives source driving signals, and when a source driving signal is higher than the common voltage signal, the positive polarity amplifier amplifies the source driving signal to generate the first amplified signal. The negative polarity amplifier receives source driving signals and when a source driving signal is lower than the common voltage signal, the negative polarity amplifier amplifies the source driving signal to generate the second amplified signal.

In accordance with the invention, the selection circuit receives the first and second amplified signals from the amplifying circuit, and selects one of the first and second amplified signals in response to the selection signal, and outputs one of the first and second amplified signals to the disconnected source line to which source driving signal is not supplied.

In one embodiment, the voltage gains of the positive polarity amplifier and the negative polarity amplifier are substantially equal to 1.

In one embodiment, the selection circuit comprises: an inverter configured to invert the selection signal; a first transmission gate configured to receive the first amplified signal and to output the first amplified signal in response to the first level of the selection signal and the inverted selection signal having the first level; and a second transmission gate configured to receive the second amplified signal and to output the second amplified signal in response to the second level of the selection signal and the inverted selection signal having the second level.

In accordance with another aspect, the invention is directed to a source driver circuit of a liquid crystal display device. The source driver circuit includes a shift register for receiving a horizontal clock signal having a clock frequency and a shift signal, the shift register being configured to generate a pulse signal every given number of clocks in response to the horizontal clock signal, and configured to generate a carry-out signal every given number of shift signals. A latch unit receives input data and is configured to latch the input data in response to the pulse signal and to output the input data in response to a load signal. A digital-to-analog (D/A) converter unit receives reference gray scale voltages to generate a plurality of gray scale voltages in response to the input data output from the latch unit based on the reference gray scale voltages. A buffer unit includes a positive polarity amplifier and a negative polarity amplifier, the buffer unit buffering the gray scale voltages to output the buffered gray scale voltages to respective corresponding source lines. A source line repair circuit receives the common voltage signal and the buffered gray scale voltages corresponding to a disconnected source line, the source line repair circuit being configured to select an amplifier having a same polarity type as a polarity type of an amplifier in the buffer unit to provide an output signal of the selected amplifier to the disconnected source line.

For example, a shift register unit receives a horizontal clock signal and a shift signal having a predetermined frequency based on the above-mentioned horizontal clock signal, generates a pulse signal every given number of clocks of the horizontal clock signal, and generates carry-out signal every given number of shift signals.

A latch unit receives input data, latches the input data in response to the pulse signal of the shift register, and outputs the input data to the level shifter based on load signals.

A digital-to-analog (D/A) converter unit receives reference gray scale voltages and the output signals of the latch unit and generates gray scale voltages in response to the output signals of the latch unit.

A buffer unit includes a positive polarity amplifier and a negative polarity amplifier, buffers the selected gray scale voltage by the D/A converter unit and outputs the buffered gray scale voltages to a corresponding source line.

A source line repair circuit receives a common voltage signal and a source driving signal corresponding to the disconnected source line, selects the amplifier having the same polarity as the polarity of the amplifier of the buffer in response to the source driving signal, and provides output signals of the amplifier to the disconnected source line to which source driving signal is not supplied.

The source driver circuit can further include a level shifter for raising a voltage level of an output signal of the latch unit between the latch unit and the D/A converter unit.

The source driver circuit can further include a switch unit to transmit an output signal of the buffer unit to the corresponding source lines in response to the load signal.

In one embodiment, the source driver circuit has two source line repair circuits.

In one embodiment, the carry-out signal generated by the shift register is inputted to a subsequent shift register.

The source driver circuit can further include a common voltage generating circuit configured to receive a high level voltage signal and a low level voltage signal, and configured to generate the common voltage signal having an intermediate voltage level between the high level voltage signal and the low level voltage signal. The high level voltage signal can be a positive first power supply voltage and the low level voltage signal can be a ground voltage level. The high level voltage of a first plurality of reference gray scale voltages can be used for the high level voltage signal, and the low level voltage of a second plurality of reference gray scale voltages can be used for the low level voltage signal. The first and second pluralities of reference gray scale voltages have a symmetric voltage level with respect to a ½ voltage level of the first power supply voltage.

In one embodiment, the common voltage generating circuit comprises: a first buffer configured to buffer the high level voltage signal; a second buffer configured to buffer the low level voltage signal; and a first resistor and a second resistor serially connected between an output terminal of the first buffer and an output terminal of the second buffer, the common voltage signal being output from a connected node between the first resistor and the second resistor.

In one embodiment, the common voltage generating circuit comprises: a first buffer configured to buffer the high level voltage signal; a second buffer configured to buffer the low level voltage signal; and a first capacitor and a second capacitor serially connected between an output terminal of the first buffer and an output terminal of the second buffer, the common voltage signal being output from a connected node between the first capacitor and the second capacitor.

In accordance with another aspect, the invention is directed to a liquid crystal display device. The liquid crystal display device includes: a liquid crystal display panel configured to display an image, the liquid crystal display panel including a plurality of source lines, a plurality of the gate lines substantially orhtogonally arranged with respect to the source lines, at least one dummy input line, and at least one dummy output line. A gate driver circuit is configured to generate a gate driving signal. A source driver circuit includes a plurality of source driver circuits, each of the source driver circuits having a buffer circuit and at least one source line repair circuit, the buffer circuit generating a source driving signal and having a positive polarity amplifier and a negative polarity amplifier, and the at least one source line repair circuit being configured to receive the common voltage signal and the source driving signal corresponding to the disconnected source line via the dummy input line, and being configured to select an amplifier having a same polarity type as a polarity type of an amplifier in the buffer unit in response to the source driving signal to provide the output signal of the selected amplifier to the disconnected source line via the dummy output line.

For example, a liquid crystal panel has the plurality of source lines and the plurality of gate lines vertically or orthogonally arranged with the plurality of source lines, and at least one dummy input line and at least one dummy output line, and displays an image. A gate driver circuit generates a gate driving signal. The source driver circuit includes the plurality of source driver ICs, and generates a source driving signal. The source driver IC includes a buffer circuit and at least one source line repair circuit. The buffer circuit includes a positive polarity amplifier and negative polarity amplifier.

The source line repair circuit receives common voltage signal and source driving signal corresponding to the disconnected source line via a dummy input line, selects the amplifier having the same polarity as the polarity of the amplifier of the buffer in response to the source driving signal. The source line repair circuit provides the output signal of a selected amplifier to the disconnected source line to which source driving signal is not supplied via a dummy output line.

In one embodiment, the source driver ICs respectively includes two source line repair circuits.

In one embodiment, when at least one source line of the source lines is disconnected, a dummy input line and a disconnected source line, and a dummy output line and the disconnected source line, are electrically connected to each other using a laser beam.

In one embodiment, when first and second source lines of the source lines are disconnected, the first source line disposed at a first region with respect to a center line of the liquid crystal display panel provides the source driving signal to the disconnected first source line using a source line repair circuit in a source driver circuit disposed at a first end of the source driver circuit, and the second source line disposed at a second region with respect to the center line of the liquid crystal display panel provides the source driving signal to the disconnected second source line using a source line repair circuit in a source driver circuit disposed at a second end of the source driver circuit.

In accordance with another aspect, the invention is directed to a method of repairing a source line, the method includes: comparing a source driving signal with a common voltage signal to output a selection signal, the selection signal having a first level when the source driving signal is higher than the common voltage signal, the selection signal having a second level when the source driving signal is lower than the common voltage signal, and the source driving signal corresponding to a disconnected source line of a liquid crystal display device; amplifying the source driving signal to output a first amplified signal and a second amplified signal; and selecting one of the first and second amplified signals in response to the selection signal to output the selected amplified signal to the disconnected source line.

For example, the method of repairing a source line includes receiving the source driving signal and the common voltage signal corresponding to the disconnected source line of an LCD device, comparing the source driving signal with the common voltage signal corresponding to the disconnected source line of an LCD device, outputting the selection signal in response to source driving signal; receiving the source driving signal, amplifying the source driving signal, outputting the first amplified signal when the source driving signal is higher than common voltage signal, and amplifying the source driving signal, outputting the second amplified signal when the source driving signal is lower than the common voltage signal, and; receiving the first amplified signal and the second amplified signal, selecting one of the first and second amplified signals in response to a selection signal, outputting one of the first and second amplified signals to the disconnected source line.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF EMBODIMENTS

Figure 2:
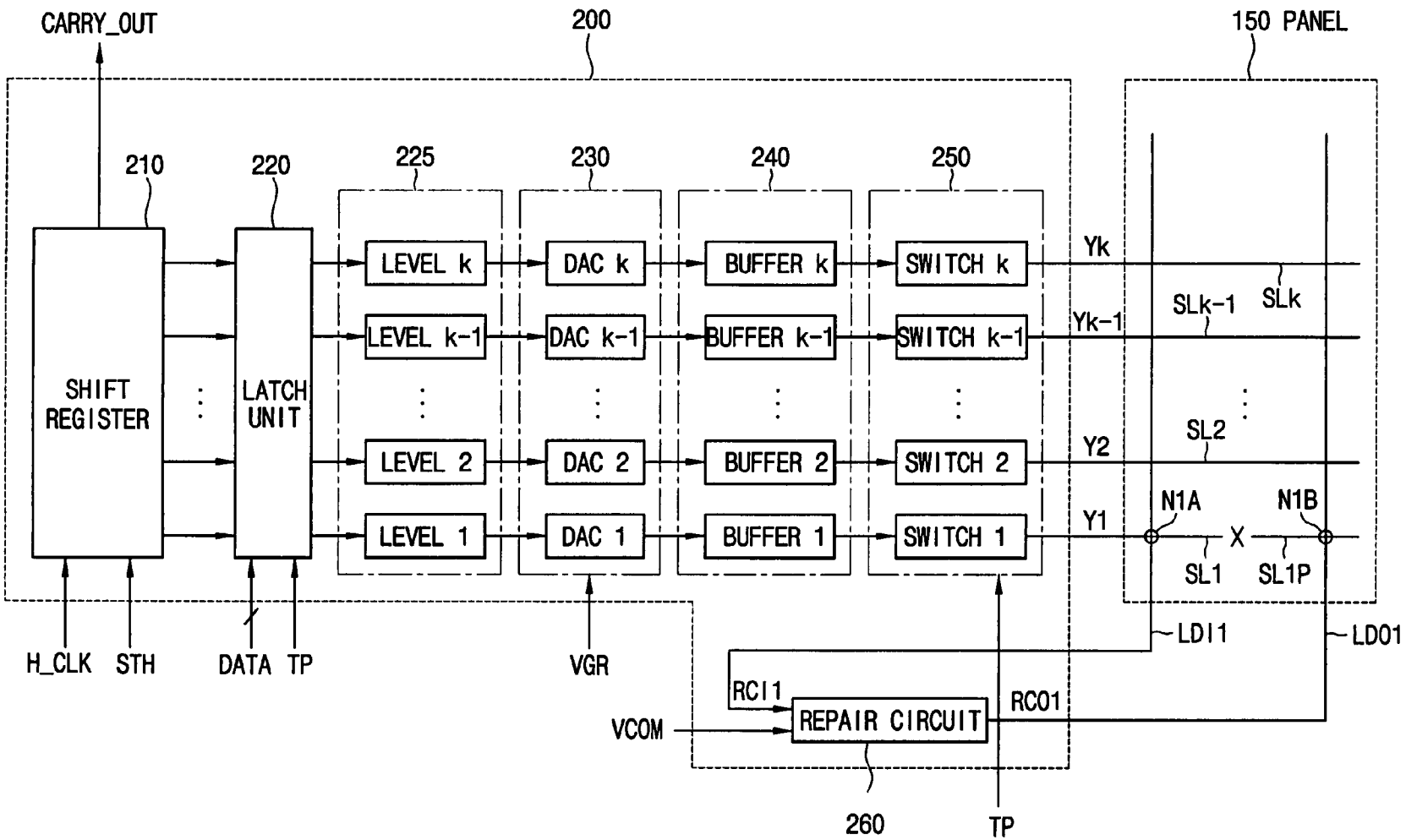
FIG. 2 is a block diagram showing an individual source driver IC of a source driver and a structure of a liquid crystal panel according to an exemplary embodiment of the present invention.

FIG. 2 shows the individual source driver IC 200 of source driver 1000 and the structure of liquid crystal panel 150 according to an exemplary embodiment of the present invention.

Referring to FIG. 2, the source driver IC 200 includes a shift register unit 210, a latch unit 200, a level shifter 225, a digital-to-analog converter DAC unit 230, a buffer unit 240, a switch unit 250 and a source line repair circuit 260.

The shift register 210 receives a horizontal clock signal H_CLK having a predetermined frequency and a shift signal STH.

The shift signal STH has a pulse every one horizontal cycle.

The shift register 210 outputs pulses to the latch unit 220 every given number of clocks in accordance with horizontal clock signals H_CLK.

A given number of shift signals generate a carry-out signal.

The carry-out signal is supplied to a following shift register unit 210 (not shown).

The latch unit 220 receives 'DATA' from the controller 100. The 'DATA' represent gray scale data.

The latch unit 220 latches the 'DATA' in response to the pulses output from the shift register 210, and outputs the 'DATA' in response to a load signal 'TP'.

The level shifter 225 raises the voltage level of the output signal of the latch unit 220.

The digital-to-analog converter 230 includes D/A converters DAC1, DAC2, . . . DAC k−1 and DAC k respectively corresponding to source line SL1, SL2, . . . , SLk−1 and SLk.

The digital-to-analog converter 230 receives reference gray scale voltages VGR from a gray scale voltage generator 120, generates k voltage signals to output the k voltage signals to the buffer unit 240 in response to the output signals of the latch unit 220.

The gray scale voltages are supplied to the source lines SL1, SL2, . . . , SLk−1 and SLk in an order in which the 'DATA' is inputted to latch unit 220.

The buffer unit 240 includes BUFFER1, BUFFER2, . . . , and BUFFERk.

The buffer unit 240 receives gray scale voltages from the DAC 230 and buffers the gray scale voltages.

The switch unit 250 includes SWITCH1, SWITCH2, . . . , SWITCHk respectively corresponding to the source line SL1, SL2, . . . , SLk−1 and SLk.

The switch unit 250 provides buffered gray scale voltages, i.e., the output signals of the buffer unit 240, to the source lines SL1, SL2, . . . , SLk−1 and SLk in response to a load signal TP.

An individual source driver IC 200 may have at least one repair circuit 260, and the source driver IC 200 has a repair circuit 260 as shown in FIG. 2.

The repair circuit 260 receives one, for example Y1, of the output signals Yl, Y2, . . . , Yk−1 and Yk of the switch unit 250 as an input signal RCI1, buffers the input signal RCI1, and generates the signal RCO1 corresponding to the signal Y1.

The repair circuit 260 provides the signal RCO1 corresponding to the output signal Y1 of a driver IC 200 to one end SL1P of a disconnected source line, to which the output signal Y1 of the source driver IC 200 is not supplied, via a dummy input line LDI1 and a dummy output line LDO1 when at least one of the source lines arranged in liquid crystal panel is disconnected.

Hereinafter, the operation of a source drive IC is described with reference to FIG. 2 according to the first exemplary embodiment of the present invention.

The source driver IC 200 receives gray scale data 'DATA' and reference gray scale voltages VGR, raises the voltage level of 'DATA', and generates k gray scale voltages to buffer k gray scale voltages in response to 'DATA'.

The buffered gray scale voltages (or source driving signals) Y1, Y2, . . . , Yk−1 and Yk are supplied to the source lines SL1, SL2, . . . , SLk−1 and SLk respectively.

When the first source line is disconnected the first source line SL1 is electrically connected with the first dummy input line LDI1, and the disconnected end SL1 P of the first source line is electrically connected with the first dummy output line LDO1.

N1A is a contact point between the first dummy input line LDI1 and the first source line SL1.

N1B is a contact point between the first dummy output line LDO1 and the disconnected end SL1P of the first source line SL1.

The first source line SL1 and the first dummy input line LDI1, and the disconnected end SL1P of the first source line and the first dummy output line LDO1 are electrically connected to each other by using a laser beam.

The first dummy input line LD1 is connected with an input terminal of the source line repair circuit 260, the first dummy output line LDO1 is connected with an output terminal of the source line repair circuit 260.

The first source driving signal Y1 is the input signal RCI1 of the source line repair circuit 260, the source line repair circuit 260 selects one of the output of a positive polarity amplifier (not shown) and the output of a negative polarity amplifier (not shown) based on a voltage level of the first source driving signal Y1, and buffers the selected output to generate a repair output signal RCO1.

The repair output signal RCO1 is supplied to the disconnected end SI1P of the first source line.

Figure 3:
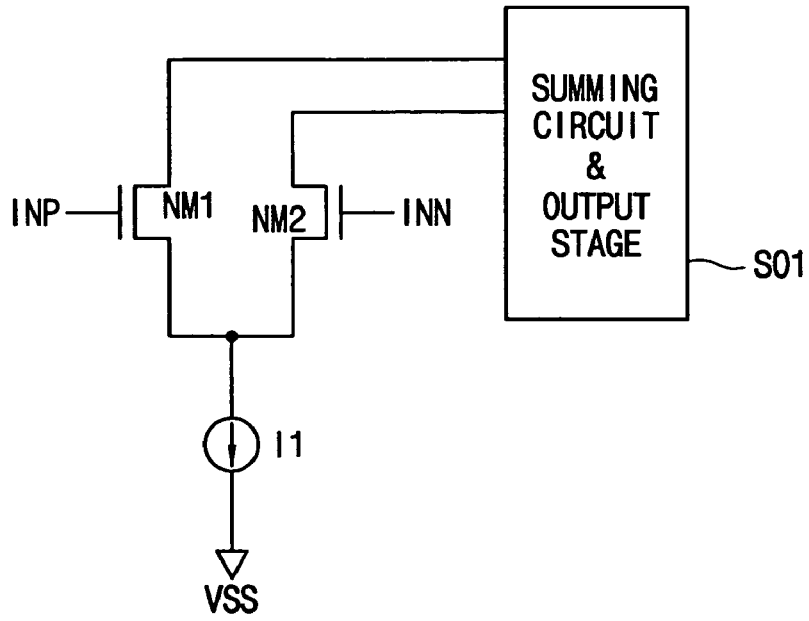
FIG. 3 is a circuit diagram showing a positive polarity amplifier according to the invention.
Figure 4:
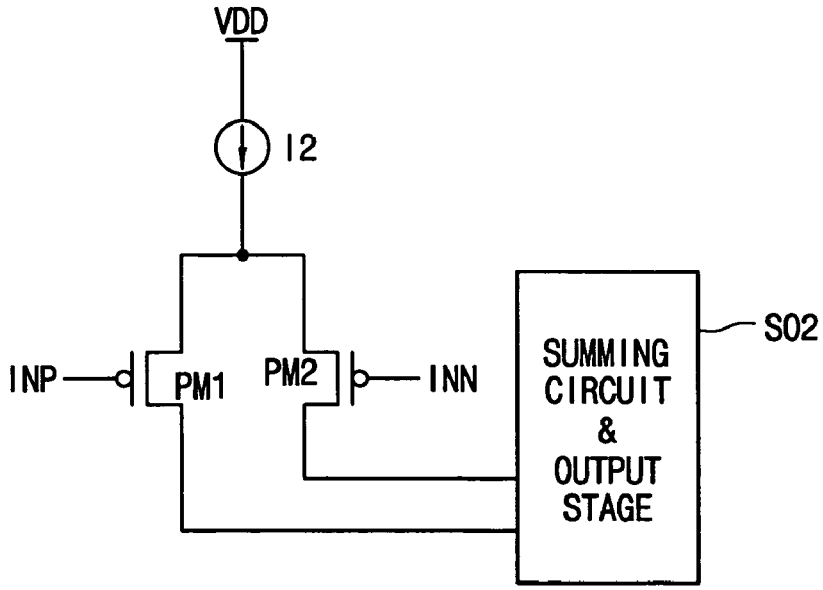
FIG. 4 is a circuit diagram showing a negative polarity amplifier according to the invention.

FIG. 3 shows a positive polarity amplifier, and FIG. 4 shows a negative polarity amplifier.

The positive polarity amplifier includes NMOS-transistors NM1 and NM2 as input transistors as shown in FIG. 3, and has an electric current sink I1 connected to a first power supply voltage VSS. The first power supply voltage VSS may have a ground or a negative voltage level.

An output line of NMOS-transistors NM1 and NM2 is connected with a summing circuit and output stage SO1.

Input signals INP and INN are supplied to gates of the NMOS-transistors NM1 and NM2, respectively, in the positive polarity amplifier of FIG. 3.

The negative polarity amplifier includes PMOS-transistors PM1 and PM2 as input transistors as shown in FIG. 4, and has an electric current source I2 connected to a second power supply voltage VDD.

An output line of the PMOS-transistors PM1 and PM2 is connected with a summing circuit and output stage SO2.

The input signals INP and INN are supplied to gates of the PMOS-transistors PM1 and PM2, respectively, in the negative polarity amplifier of FIG. 4.

The positive polarity amplifier amplifies an input signal having a voltage level above the common voltage signal VCOM, and the negative polarity amplifier amplifies an input signal having a voltage level below the common voltage signal VCOM.

Figure 5:
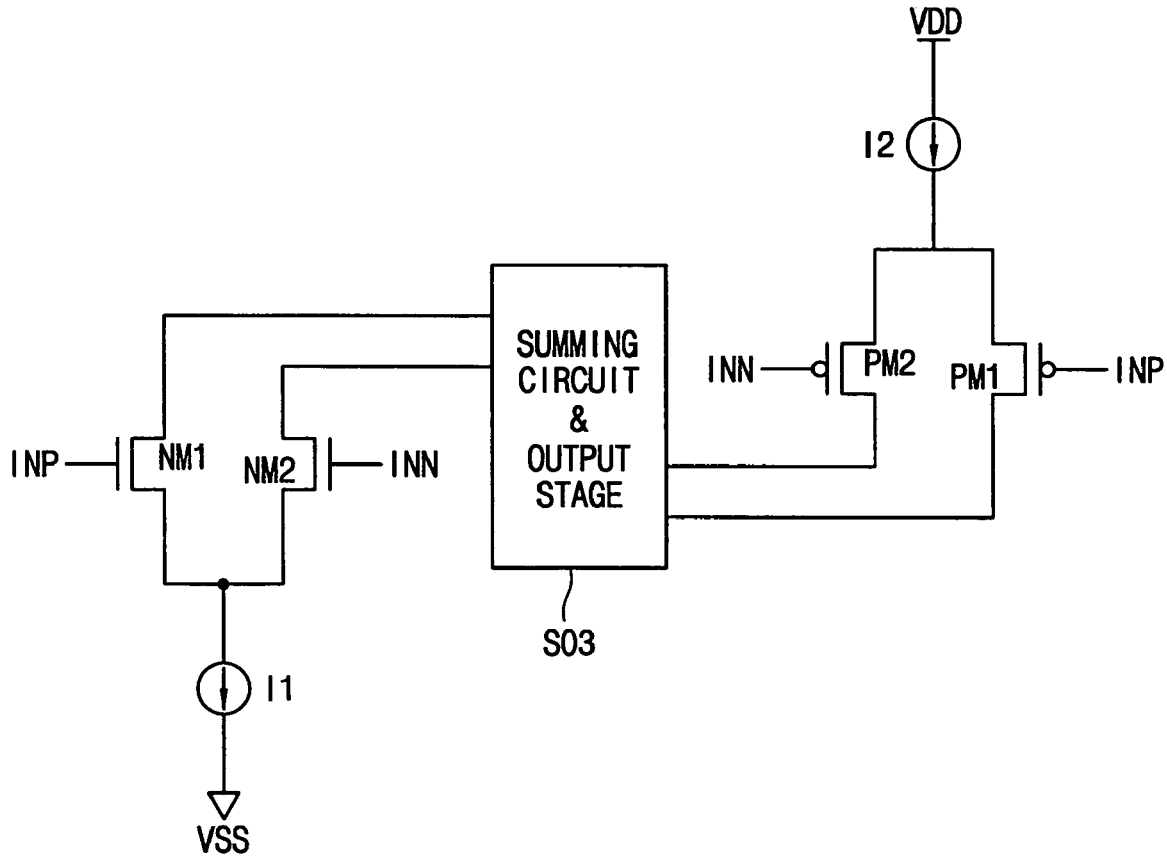
FIG. 5 is a circuit diagram showing a rail-to-rail amplifier according to the invention.

FIG. 5 shows the rail-to-rail amplifier, and the rail-to-rail amplifier has a structure in which the positive polarity amplifier is coupled with the negative polarity amplifier.

As shown in FIG. 5, the rail-to-rail amplifier has the NMOS-transistors NM1, NM2 and PMOS-transistors PM1, PM2 as an input transistor.

The output line of the NMOS-transistors NM1, NM2 and PMOS-transistors PM1, PM2 are connected with the summing circuit and output stage SO3.

The input signal INP is supplied to the NMOS-transistor NM1 and PMOS-transistor PM1, the input signal INN is supplied to the NMOS-transistor NM2 and PMOS-transistor PM2.

The rail-to-rail amplifier has an advantage that the rail-to-rail amplifier operates in a wide voltage range from the second power supply voltage VDD to the first power supply voltage VSS.

The gray scale voltages of the TFT-LCD device may alternately have a positive polarity voltage level higher than the common voltage signal VCOM and a negative polarity voltage level lower than the common voltage signal VCOM.

The output signals, i.e., the source driving signals Y1, Y2, . . . , Yk−1 and Yk, of the source driver IC 200 may alternately have the positive polarity voltage level and the negative polarity voltage level.

In the source driver IC 200 of FIG. 2, the buffers BUFFER1, BUFFER2, . . . , and BUFFERk constituting the buffer unit 240 alternately has the positive polarity amplifier and the negative polarity amplifier.

Since only one or two source lines in the TFT-LCD panel usually are disconnected, it is not desirable in consideration of chip size that each of the source lines has a source line repair circuit.

The repair circuit 260 uses an amplifier having the same polarity as the polarity of the amplifier of the buffer corresponding to the source line that needs to be repaired by the repair circuit 260.

For example, the buffers BUFFER1, BUFFER2, . . . , and BUFFERk of the buffer unit 240 may have the positive polarity amplifier or the negative polarity amplifier, and the source line repair circuit 260 may have the rail-to-rail amplifier shown in FIG. 5.

Alternatively, the rail-to-rail amplifier may be respectively used for the buffers BUFFER1, BUFFER2, . . . , BUFFERk−1 and BUFFERk and the source line repair circuit 260.

Figure 6:
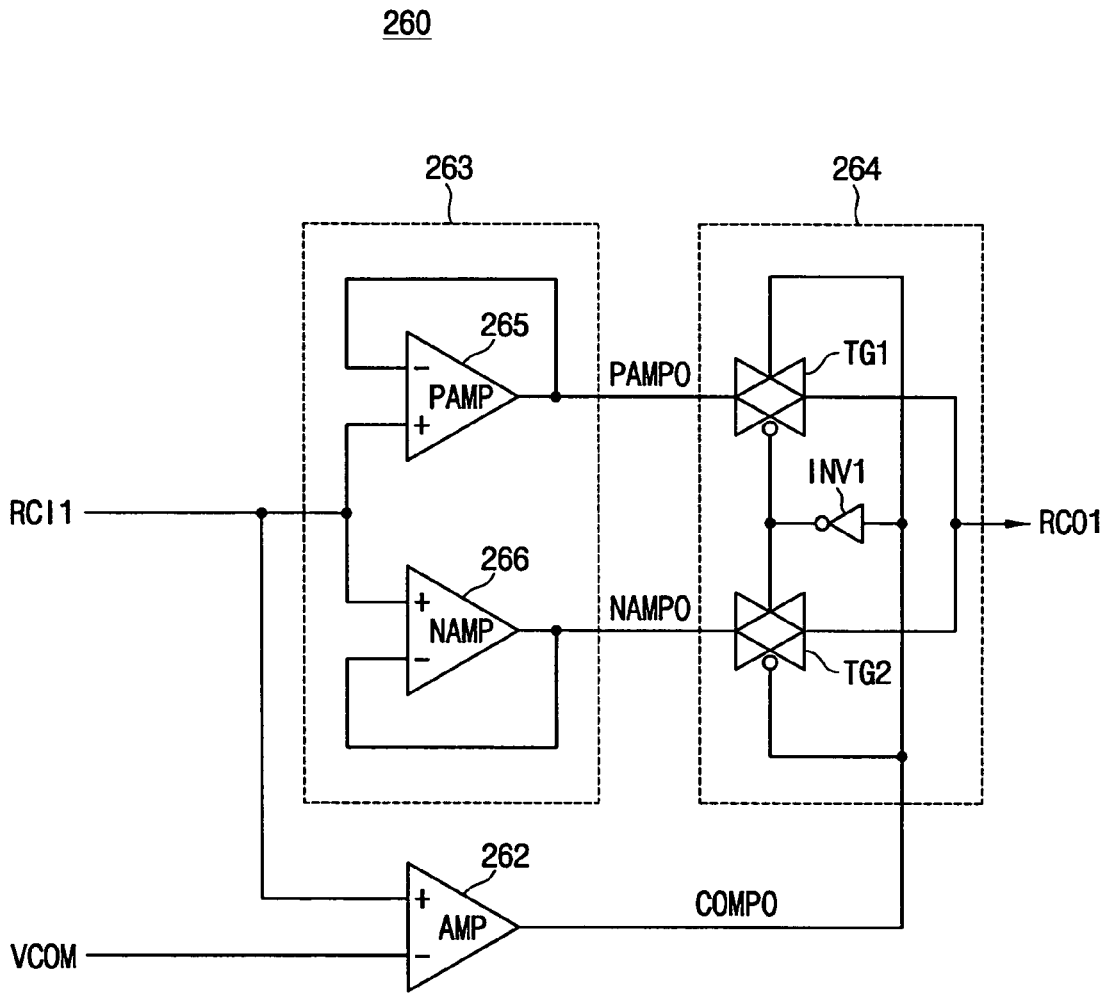
FIG. 6 is a circuit diagram showing a structure of a repair circuit shown in FIG. 2.

FIG. 6 is a circuit diagram showing a structure of one embodiment of a repair circuit 260 shown in FIG. 2.

The source line repair circuit 260 includes a comparator 262, an amplifying circuit 263, and a selection circuit 264.

The comparator 262 receives the input signal RCI1 and the common voltage signal VCOM, compares the input signal RCI1 with the common voltage signal VCOM, and outputs a selection signal COMPO based on a voltage level of the source driving signal.

The input signal RCI1 is a source driving signal corresponding to the disconnected source line of the LCD device.

The amplifying circuit 263 receives the input signal RCI1, amplifies the input signal RCI1 to output the first amplified signal PAMPO and the second amplified signal NAMPO.

The selection circuit 264 receives the first amplified signal PAMPO and the second amplified signal NAMPO from the amplifying circuit 263, selects one of the first amplified signal PAMPO and the second amplified signal NAMPO in response to the selection signal COMPO, and outputs the selected amplified signal to a disconnected end of the source line. The amplifying circuit 263 includes a positive polarity amplifier 265 and a negative polarity amplifier 266.

The positive polarity amplifier 265 receives the input signal RCI1, amplifies the input signal RCI1, and generates the first amplified signal PAMPO.

The negative polarity amplifier 266 receives the input signal RCI1, amplifies the input signal RCI1 and generates the second amplified signal NAMPO.

A voltage gain of the positive polarity amplifier 265 and the negative polarity amplifier 266 is respectively equal to substantially 1 because an inverting input terminal and an output terminal of each of the positive polarity amplifier 265 and the negative polarity amplifier 266 are short-circuited.

The selection circuit 264 includes an inverter INV1, a first transmission gate TG1, and a second transmission gate TG2.

The inverter INV1 inverts the selection signal COMPO.

The first transmission gate TG1 outputs the first amplified signal PAMPO as a repair signal RCO1 based on the selection signal COMPO and the output signal of the inverter INV1.

The second transmission gate TG2 outputs the second amplified signal NAMPO as a repair signal RCO1 based on the selection signal COMPO and the output signal of the inverter INV1.

Hereinafter, the operation of the source line repair circuit of FIG. 6 is described.

The input signal RCI1 of the source line repair circuit 260 is one of the source line driving signals Y1, Y2, . . . , Yk−1 and Yk of FIG. 2.

When the input signal RCI1 is higher than the common voltage signal VCOM, the selection signal COMPO of the comparator 262 has a logical 'high' level.

Consequently, the first transmission gate TG1 has a turn-on state, and the second transmission gate TG2 has a turn-off state.

Thus, the first amplified signal PAMPO of the positive polarity amplifier 265 is output as a repair signal RCO1 via the first transmission gate TG1.

When the input signal RCI1 is lower than the signal of the common voltage VCOM, the output signal of the comparator 262 has a logical-'low' level.

Consequently, the transmission gate TG1 has the turn-off-state, and the transmission gate TG2 has the turn-on-state.

Thus, the second amplified signal NAMPO of the negative polarity amplifier 266 is output as the repair signal RCO1 via the second transmission gate TG2.

Figure 7:
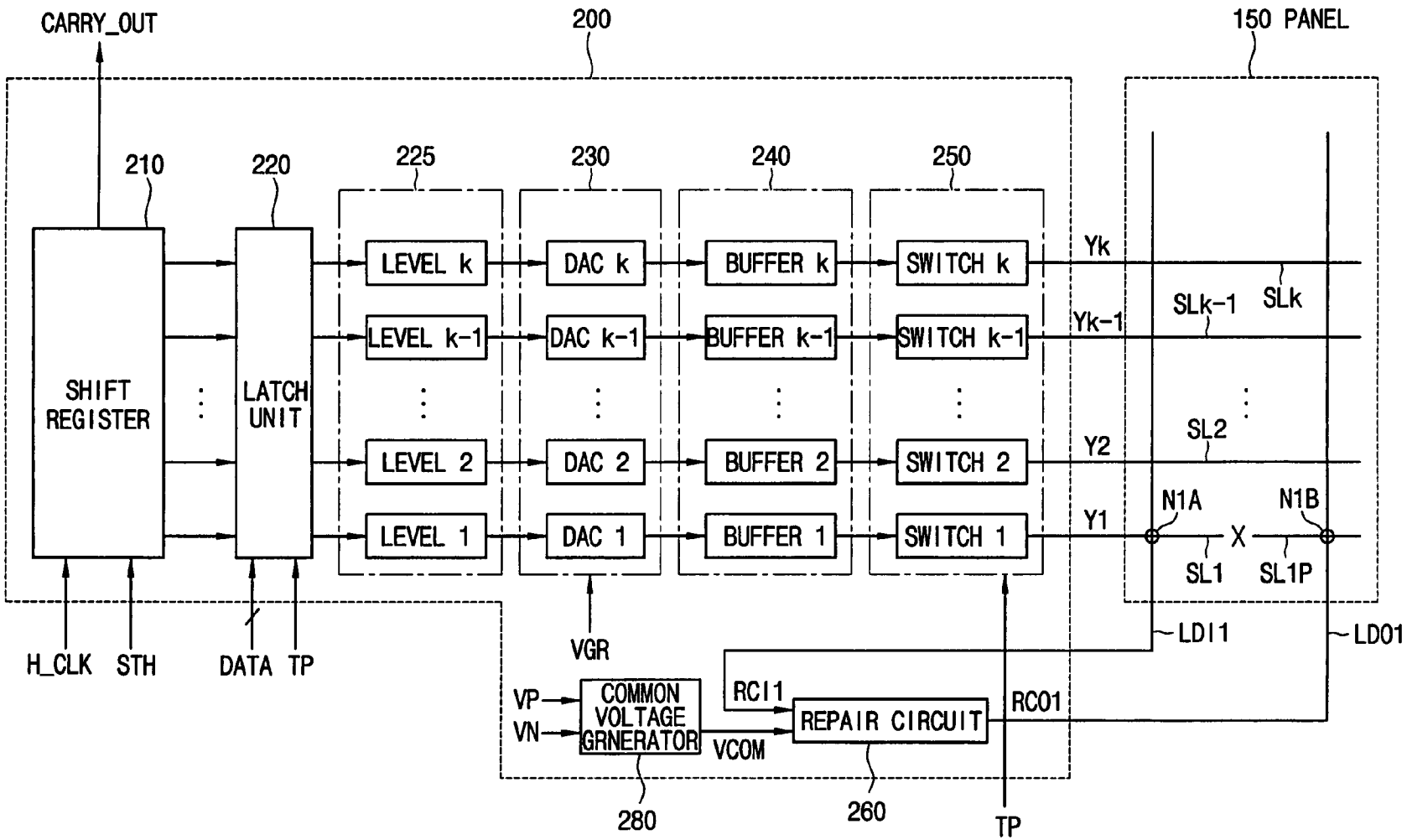
FIG. 7 is a block diagram showing an individual source driver IC of a source driver and a structure of an LCD panel according to another exemplary embodiment of the present invention.

FIG. 7 shows the individual source driver IC 200 of source driver 1000 and the structure of liquid crystal panel 150 according to another exemplary embodiment of the present invention.

The difference between the source driver IC 200 of FIG. 7 and the source driver IC 200 of FIG. 2 is that the source driver IC 200 of FIG. 7 includes a common voltage generator 280, which is implemented inside the source driver IC 200, for generating the common voltage signal VCOM used by the source line repair circuit 260.

The common voltage generator 280 receives a high level voltage signal VP and a low level voltage signal VN, generates the common voltage signal VCOM having an intermediate voltage level between the high level voltage signals VP and low level voltage signals VN.

The first power supply voltage VDD may be used for the high level voltage signal VP and the second power supply voltage VSS may be used for the low level voltage signal VN.

Alternatively, a high level voltage of a plurality (couple) of reference gray scale voltages VGR may be used for the high level voltage signal VP, and a low level voltage of a plurality (couple) of reference gray scale voltages VGR may be used for the low level voltage signal VN.

The plurality of reference gray scale voltages have a symmetric voltage level with respect to a ½ voltage level of the first power supply voltage VDD.

Since the source driver IC 200 of FIG. 7 has a same structure as the source driver IC 200 of FIG. 2 except that the source driver IC 200 of FIG. 7 includes the common voltage generator 280 inside the source driver IC 200, detailed descriptions concerning the circuit 200 of FIG. 7 will not be repeated.

Figure 8:
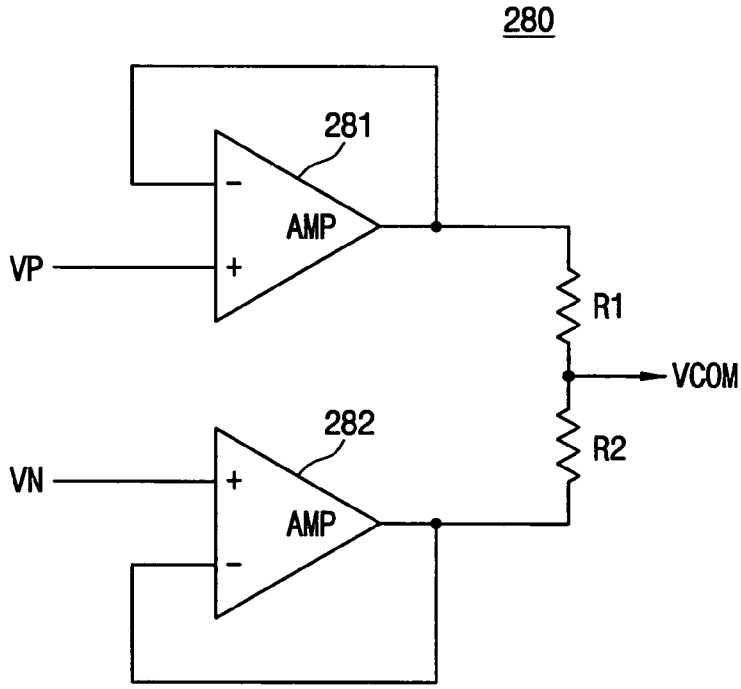
FIG. 8 is a circuit diagram showing an example of structure of a common voltage generating circuit according to the invention.
Figure 9:
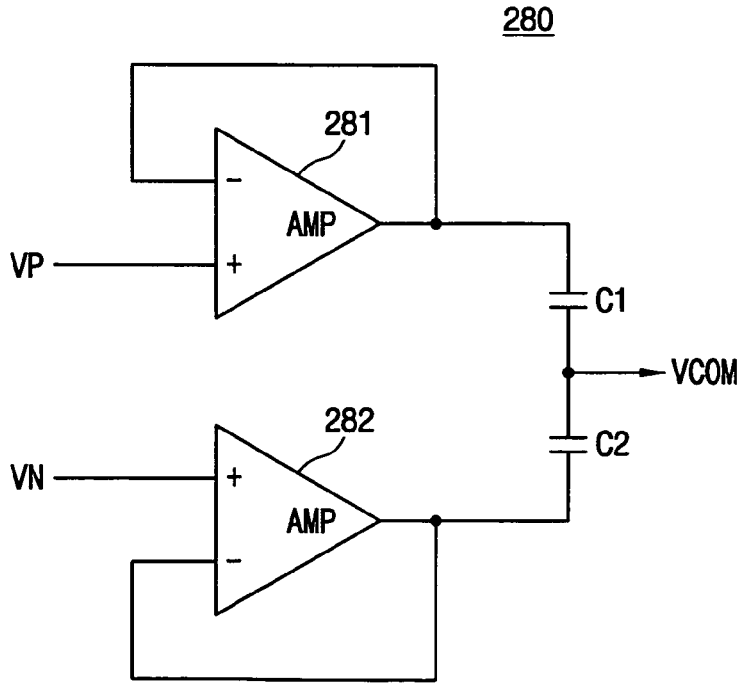
FIG. 9 is a circuit diagram showing another example of structure of a common voltage generating circuit according to the invention.

FIG. 8 and FIG. 9 are circuit diagrams showing examples of the common voltage generator 280.

The common voltage generating circuit 280 of FIG. 8 includes a first operational amplifier 281, a second operational amplifier 282, resistors R1 and R2.

The inverting input terminal and the output terminal of the first operational amplifier 281 are short-circuited, and the first operational amplifier 281 receives the high level voltage signal VP via a non-inverting input terminal.

The inverting input terminal and the output terminal of the second operational amplifier 282 are short-circuited, and the second operational amplifier 282 receives the low level voltage signal VN via a non-inverting input terminal.

The resistor R1 is serially connected with the resistor R2 between the output terminal of the first operational amplifier 281 and the output terminal of the second operational amplifier 282, the common voltage signal VCOM is output from the coupled node of R1 and R2.

The common voltage generating circuit 280 of FIG. 9 includes the first operational amplifier 281, the second operational amplifier 282, capacitors C1 and C2.

The difference between the common voltage generating circuit 280 of FIG. 9 and the common voltage generating circuit 280 of FIG. 8 is that the common voltage generating circuit 280 of FIG. 9 distributes the voltage by a ratio of capacitors C1 and C2.

The inverting input terminal and the output terminal of the first operational amplifier 281 are short-circuited, and the first operational amplifier receives the high level voltage signal VP via a non-inverting input terminal.

The inverting input terminal and the output terminal of the second operational amplifier 282 are short-circuited, and the second operational amplifier receives the low level voltage signal VN via a non-inverting input terminal.

The capacitor C1 is serially connected with the capacitor C2 between the output terminal of the first operational amplifier 281 and the output terminal of the second operational amplifier 282, the common voltage signal VCOM is output from the coupled node of C1 and C2.

The operational amplifiers 281 and 282 are used at the common voltage generating circuits 280 of FIG. 8 and FIG. 9 so as to prevent the change of the high level voltage signal VP and the low level voltage signal VN.

Alternatively, the common voltage signal VCOM may be generated by using the resistors R1 and R2 or the capacitors C1 and C2 without the first and second operational amplifiers 281 and 282.

Figure 10:
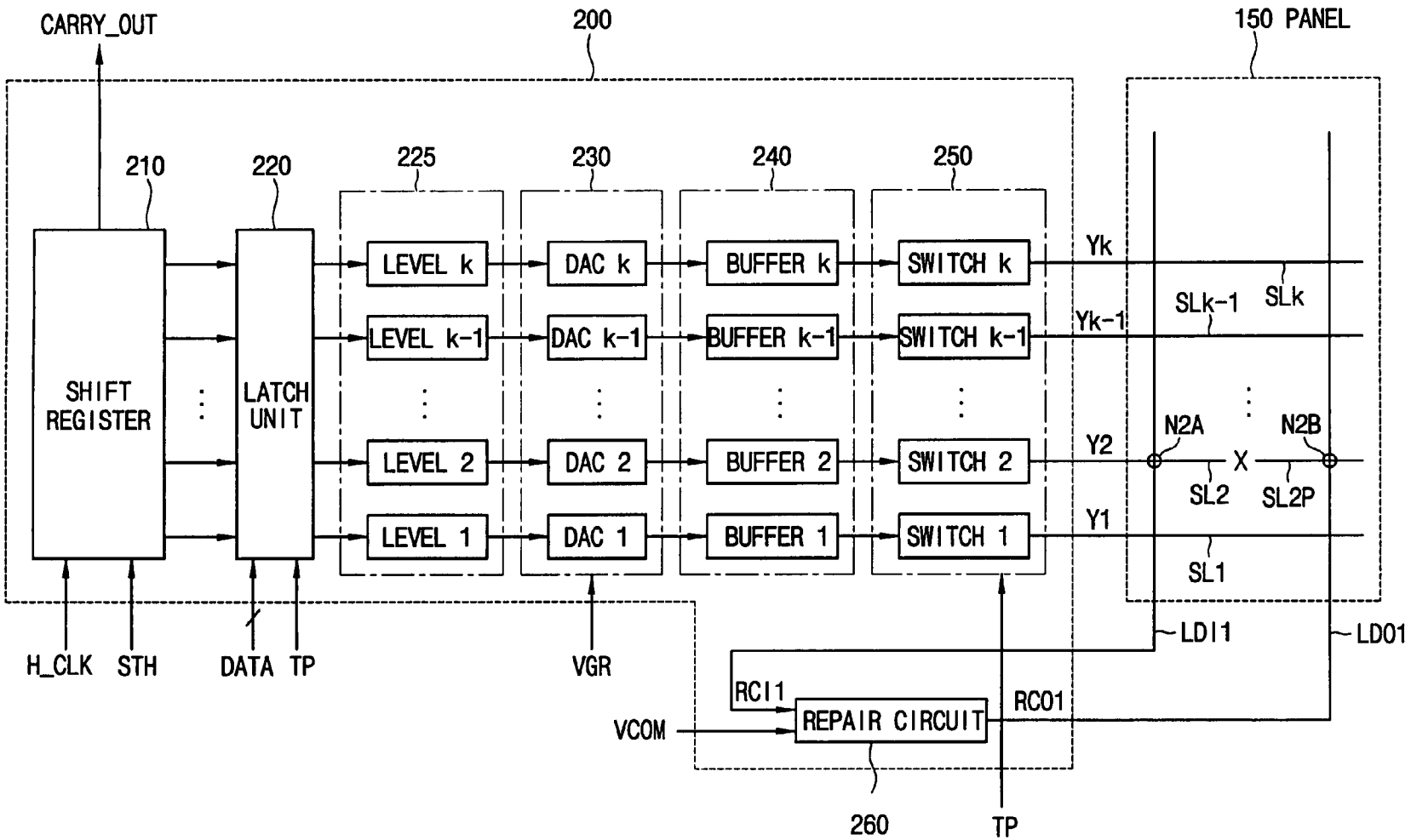
FIG. 10 is a block diagram illustrating a recovery method when the second source line SL2 is disconnected to the circuit of FIG. 2.

FIG. 10 is a circuit diagram illustrating a recovery method when the second source line SL2 is disconnected to the source driver IC 200 of FIG. 2.

When the second source line among the source lines SL1, SL2, . . . , SLk−1 and SLk is disconnected, the second source line SL2 is electrically connected with the first dummy input line LDI1, and the disconnected end SL2P of the second source line SL2 is electrically connected with the first dummy output line LDO1.

N2A is a contact point between the first dummy input line LDI1 and the second source line SL2.

N2B is a contact point between the first dummy output line LDO1 and the disconnected end SL2P of the second source line SL2.

The first dummy input line LDI1 is connected with an input terminal of the source line repair circuit 260, and the first dummy output line LDO1 is connected with an output terminal of the source line repair circuit 260.

The second source driving signal Y2 of the source driver IC 200 is the input signal RCI1 of the source line repair circuit 260.

The source line repair circuit 260 selects one of the outputs of the positive polarity amplifier (not shown) and the negative polarity amplifier (not shown) based on the voltage level of the second source driving signal Y2, buffers the selected output of the positive (or negative) polarity amplifier to generate a repair output signal RCO1.

The repair output signal RCO1 is supplied to a one end SL2P of the second source line SL2 disconnected from the source driver IC 200.

Figure 11:
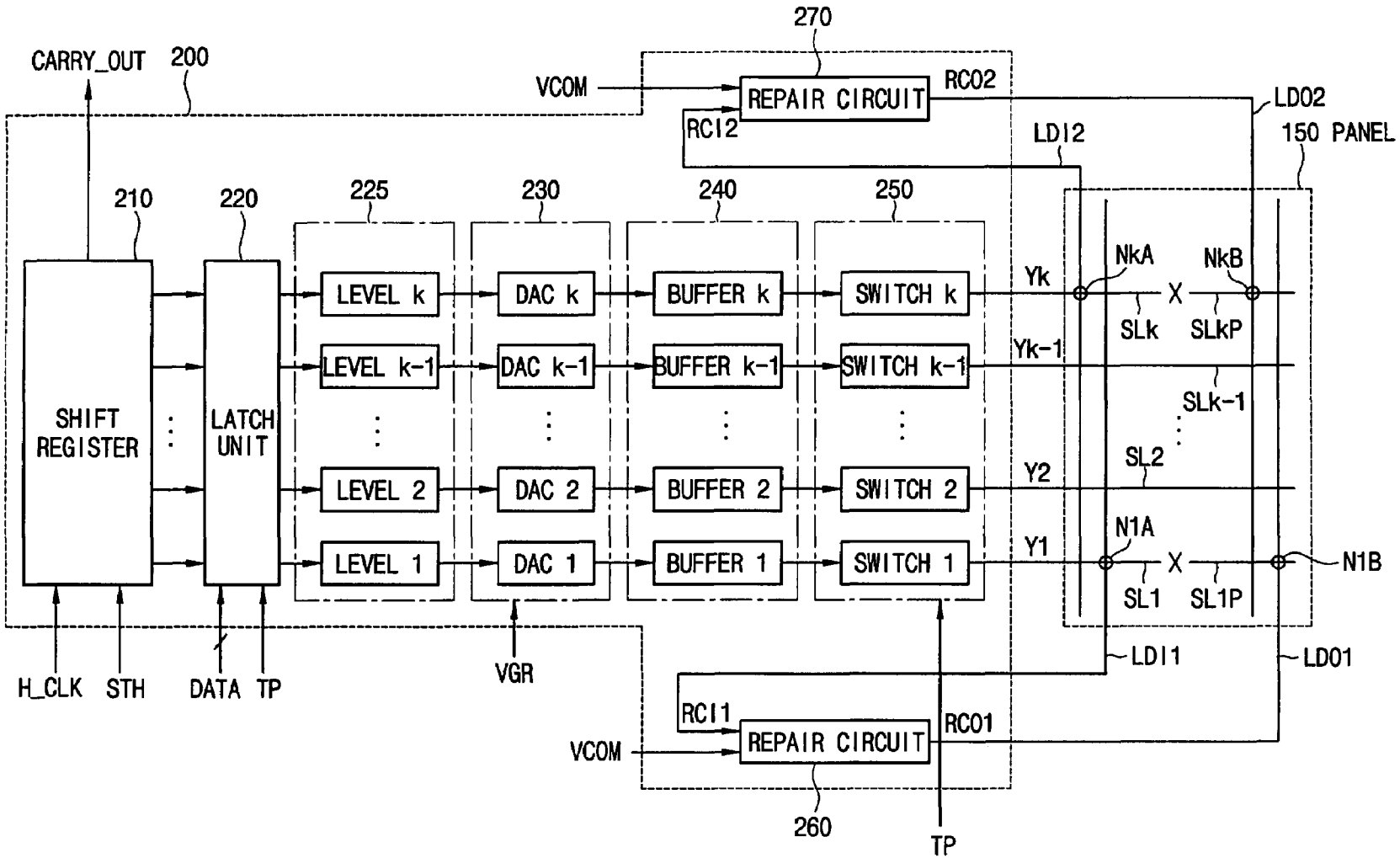
FIG. 11 is a block diagram showing an individual source driver IC of a source driver and the structure of an LCD panel according to other exemplary embodiment of the present invention.

FIG. 11 is a block diagram showing an individual source driver IC 200 of a source driver 1000 and a structure of a liquid crystal display panel 150 according to exemplary embodiment of the present invention.

In the source driver IC 200 of FIG. 11, the first source line repair circuit 260 is disposed near the first source line SL1, and the second source line repair circuit 270 is disposed near the $k^{th}$ source line SLk.

Hereinafter, when the first source line SL1 and the $k^{th}$ source line SLk among the source lines SL1, SL2, . . . , SLk−1 and SLk are disconnected, the repair method is described with reference to FIG. 11.

In order to repair the first source line SL1, the first source line SL1 is electrically connected with the first dummy input line LDI1, and the disconnected end SL1P of the first source line SL1 is electrically connected with the first dummy output line LDO1.

The first source line SL1 and the first dummy input line LDI1, and the disconnected end SL1P of the first source line and the first dummy output line LDO1 are 20 electrically connected to each other by using the laser beam.

The first dummy input line LDI1 is coupled to the input terminal of the source line repair circuit 260, the first dummy output line LDO1 is coupled to the output terminal of the source line repair circuit 260.

The first source driving signal Y1 is the input signal RCI1 of the source line repair circuit 260, the source line repair circuit 260 selects one of the outputs of the positive polarity amplifier (not shown) and the outputs of the negative polarity amplifier (not shown) based on the voltage level of the first source driving signal Y1 to generate the repair output signal RCO1.

The repair output signal RCO1 is supplied to the disconnected end SL1P of the first source line.

In order to repair the $k^{th}$ source line, the $k^{th}$ source line SLk is electrically connected with the second dummy input line LDI2, and the disconnected end SLkP of the $k^{th}$ source line is electrically connected with the second dummy output line LDO2.

NkA is a contact point between the second dummy input line LDI2 and the $k^{th}$ source line SLk.

NkB is a contact point between the second dummy output line LDO2 and the disconnected end SLkP of the $k^{th}$ source line SLk.

The $k^{th}$ source line SLk and the second dummy input line LDI2, and the disconnected end SLkP of the $k^{th}$ source line and the second dummy output line LDO2 are electrically connected to each other using the laser beam.

The second dummy input line LDI2 is connected with an input terminal of the source line repair circuit 270, the second dummy output line LDO2 is connected with an output terminal of the source line repair circuit 270.

The $k^{th}$ source driving signal Yk is the input signal RCI2 of the source line repair circuit 270, the source line repair circuit 270 selects one of the outputs of the positive polarity amplifier (not shown) and the output of the negative polarity amplifier (not shown) based on the voltage level of the $k^{th}$ source driving signal Yk and buffers the selected output to generate the repair output signal RCO2.

The repair output signal RCO2 is supplied to the disconnected end SLkP of the $k^{th}$ source line.

Figure 12:
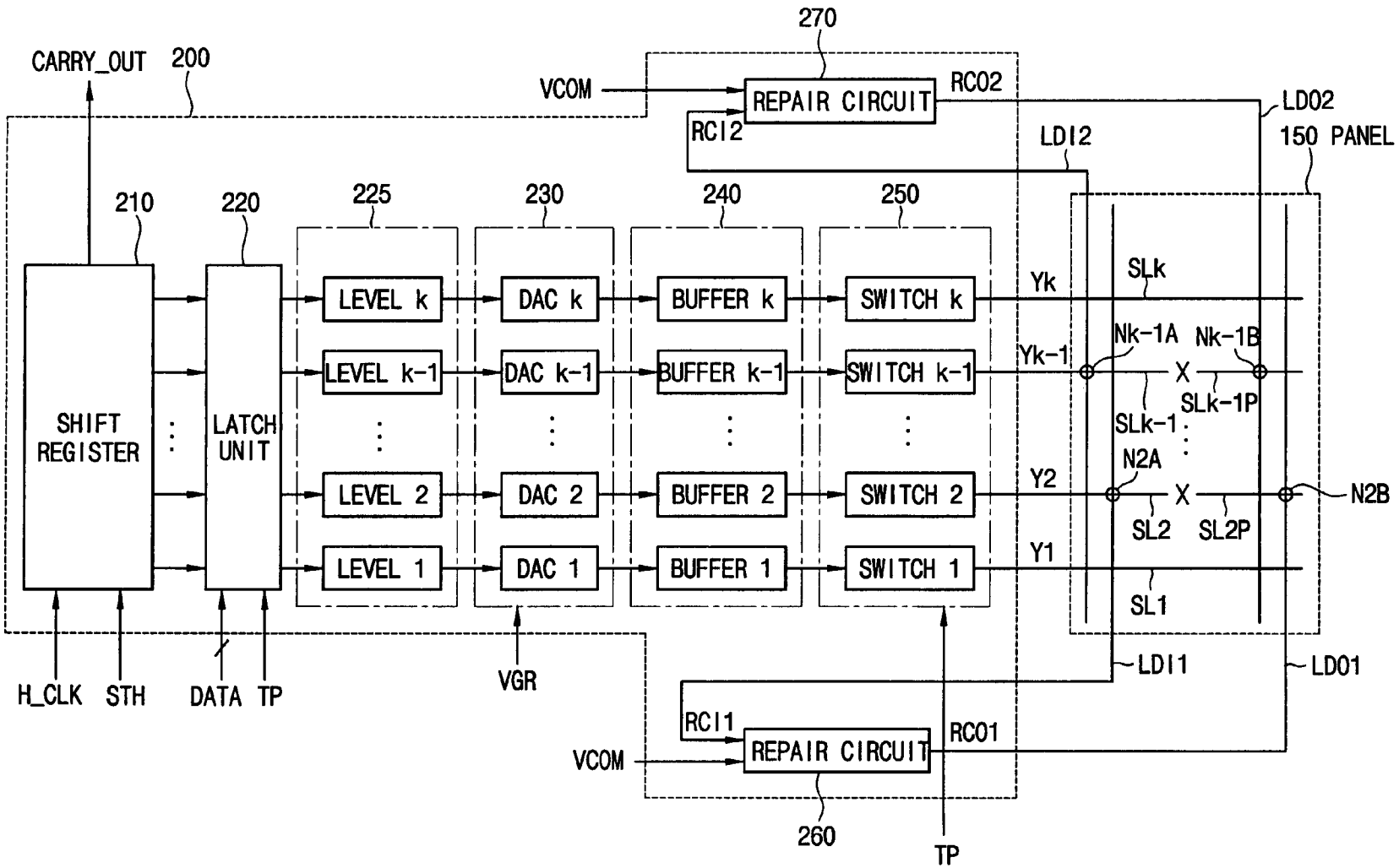
FIG. 12 is a block diagram illustrating the recovery method when the second source line SL2 or $(k-1)^{th}$ source line is disconnected to the liquid crystal panel of FIG. 11.

FIG. 12 is a circuit diagram illustrating a recovery method when the second source line SL2 and the $(k-1)^{th}$ source line SLk−1 are disconnected to the source driver IC 200 of FIG. 11.

Hereinafter, when the second source line SL2 and the $(k-1)^{th}$ source line SLk among SL1, SL2, . . . , SLk−1 and SLk are disconnected, the repair method is described with reference to FIG. 12.

In order to repair r the second source line, the second source line SL2 is electrically connected with the first dummy input line LDI1, the disconnected end SL2P of the second source line SL2 is electrically connected with the first dummy output line LDO1.

The second source line SL2 and the first dummy input line LDI1, and the disconnected end SL2P of the second source line and the first dummy output line LDO1 are electrically connected to each other using the laser beam.

The first dummy input line LDI1 is connected with an input terminal of the source line repair circuit 260, the first dummy output line LDO1 is connected with an output terminal of the source line repair circuit 260.

The second source driving signal Y2 is the input signal RCI1 of the source line repair circuit 260, the source line repair circuit 260 selects one of the outputs of the positive polarity amplifier (not shown) and the output of the negative polarity amplifier (now shown) based on the voltage level of the second source driving signal Y2, and buffers the selected output to generate the repair output signal RCO1.

The repair output signal RCO1 is supplied to the disconnected end SL2P of the second source line.

In order to repair the $(k-1)^{th}$ source line, the $(k-1)^{th}$ source line SLk−1 is electrically connected with the second dummy input line LDI2, and the disconnected end SLk−1P of the $(k-1)^{th}$ source line is electrically connected with the second dummy output line LDO2.

Nk−1A is a contact point between the second dummy input line LDI2 and the $(k-1)^{th}$ source line SLk−1 .

Nk−1B is a contact point between the second dummy output line LDO2 and the disconnected end SLk−1P of the $(k-1)^{th}$ source line SLk−1 .

The $(k-1)^{th}$ source line SLk−1 and the second dummy input line LDI2, and the disconnected end SLk−1P of the $(k-1)^{th}$ source line and the second dummy output line LDO2 are electrically connected to each other using the laser beam.

The second dummy input line LDI2 is connected with an input terminal of the source line repair circuit 270, the second dummy output line LDO2 is connected with an output terminal of the source line repair circuit 270.

The $(k-1)^{th}$ source driving signal Yk−1 is the input signal RCI2 of the source line repair circuit 270, the source line repair circuit 270 selects one of the outputs of the positive polarity amplifier (not shown) and the output of the negative polarity amplifier (not shown) based on the voltage level of the $(k-1)^{th}$ source driving signal Yk−1, and buffers the selected output to generate the repair output signal RCO2.

The repair output signal RCO2 is supplied to the disconnected end SLk−1P of the $(k-1)^{th}$ source line.

The LCD device as shown in FIG. 11 and FIG. 12 may safely provide the source driving signals to the two source lines disconnected from the source driver IC by using two source line repair circuits 260 and 270.

When the source lines near to the first source line repair circuit 260 are disconnected, the first source line repair circuit 260 repairs the disconnected source line, and when the source lines near to the second source line repair circuit 270 are disconnected, the second source line repair circuit 270 repairs the disconnected source line.

Figure 1:
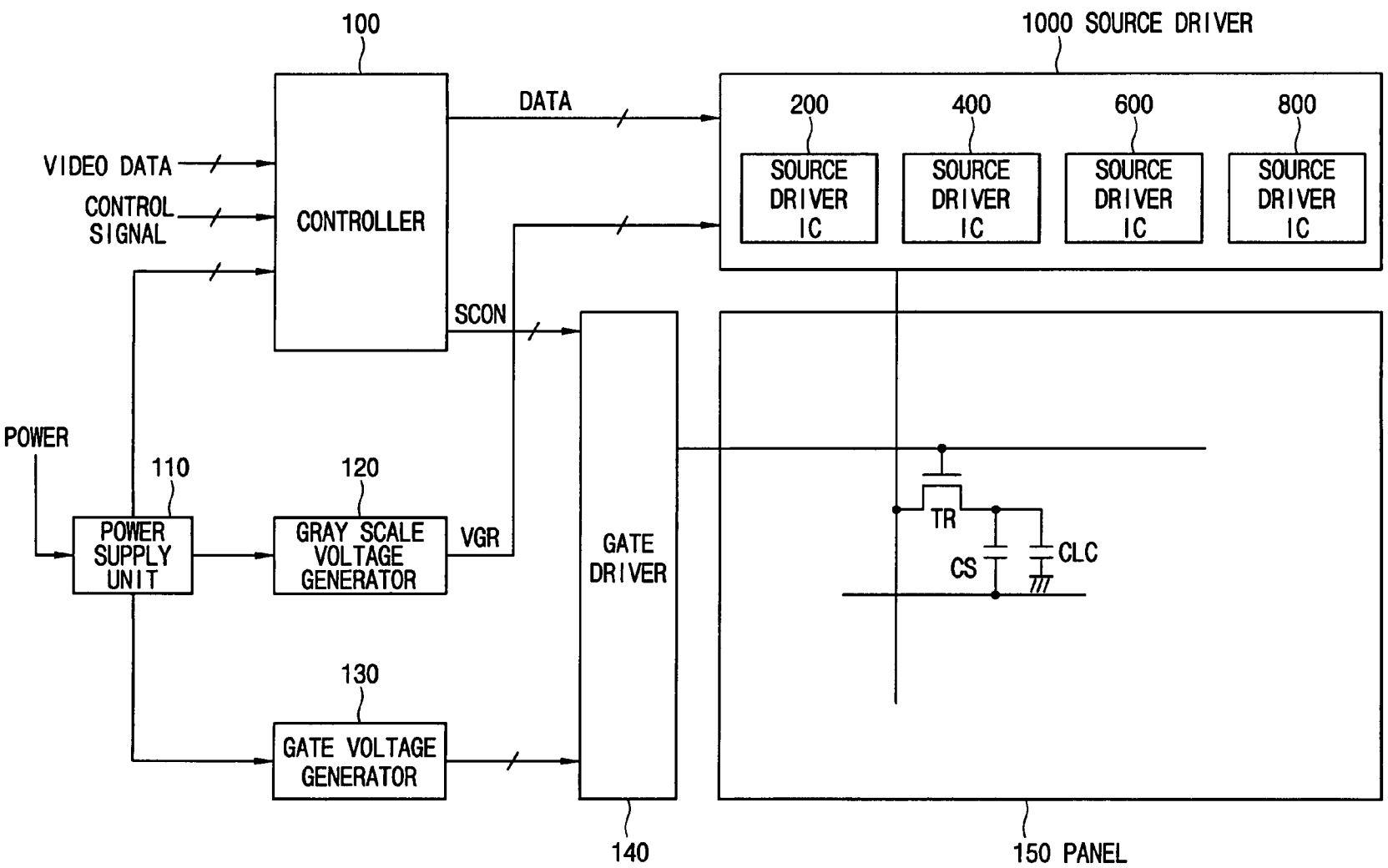
FIG. 1 is a schematic diagram showing a conventional active matrix LCD device.
Figure 13:
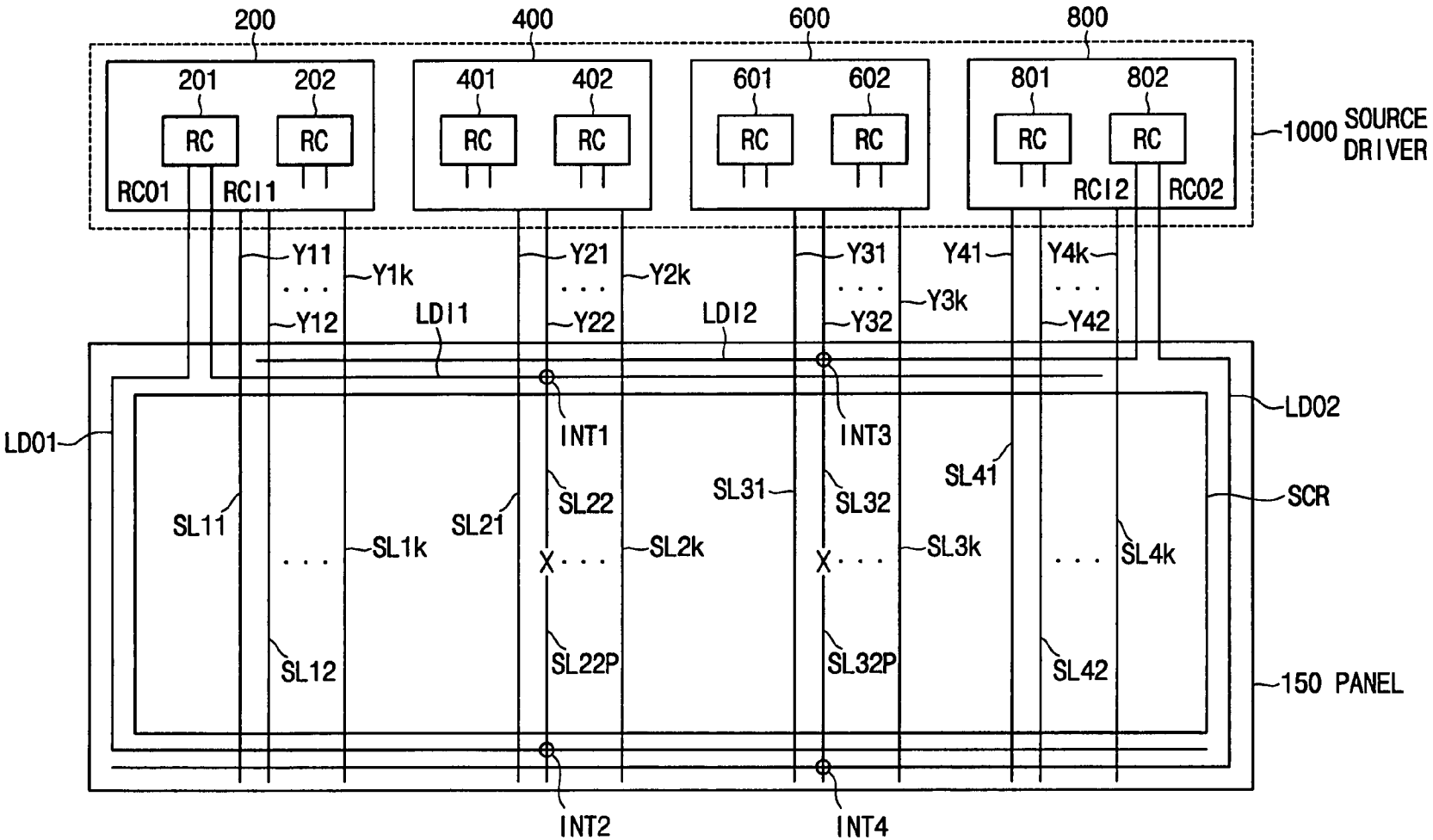
FIG. 13 is a block diagram illustrating a recovery method of an LCD panel that has two disconnections.

FIG. 13 is a block diagram illustrating a recovery method of an LCD panel 150 that has two disconnections. FIG. 13 only illustrates a display panel 150 of the LCD device and the source driver 1000. The other elements of the LCD device of FIG. 13 are the same as those of the LCD device of FIG. 1. For example, FIG. 13 illustrates an example of the source driver 1000 having four source driver ICs 200,400,600 and 800.

Referring to FIG. 13, the source driver unit 1000 includes the source driver ICs 200, 400, 600 and 800 respectively having two source line repair circuits.

The first source driver IC 200 has the source line repair circuits 201 and 202, the second source driver IC 400 has the source line repair circuits 401 and 402, the third source driver IC 600 has the source line repair circuits 601 and 602, and the fourth source driver IC 800 has the source line repair circuits 801 and 802.

The source driver IC 200 is connected with the source lines SL11, SL12, . . . , SL1k, the source driver IC 400 is connected with the source lines SL21, SL22, . . . , SL2k, the source driver IC 600 is connected with the source lines SL31, SL32, . . . , SL3k, the source driver IC 800 is connected with the source lines SL41, SL42, . . . , SL4k.

In the example of the LCD device shown in FIG. 13, the second source line SL22 connected to the source driver IC 400 and the second source line SL32 connected to the source driver IC 600 are disconnected.

The dummy input lines LDI1 and LDI2 and the dummy output lines LDO1 and LDO2 are disposed at the external region surrounding a screen SCR in the display panel 150.

To repair the source line SL22, the source line SL22 is electrically connected with the first dummy input line LDI1, the disconnected end SL22P of the source line SL22 is electrically connected with the first dummy output line LDO1.

INT1 is a contact point between the first dummy input line LDI1 and the source line SL22.

INT2 is a contact point between the first dummy output line LDO1 and the disconnected end SL22P of the source line SL22.

The source line SL22 and the first dummy input line LDI1, and the disconnected end SL22P of the source line SL22 and the first dummy output line LDO1 are electrically connected to each other using the laser beam.

The first dummy input line LDI1 is connected with an input terminal of the source line repair circuit 201, the first dummy output line LDO1 is connected with an output terminal of the source line repair circuit 201.

The second source driving signal Y22 is the input signal RCI1 of the source line repair circuit 201, the source line repair circuit 201 selects one of the outputs of the positive polarity amplifier (not shown) and the output the negative polarity amplifier (not shown) based on the voltage level of the second source driving signal Y22, and buffers the selected output to generate the repair output signal RCO1.

The repair output signal RCO1 is supplied to the disconnected end SL22P of the second source line SL22 in the source driver IC 400.

To repair the source line SL32, the source line SL32 is electrically connected with the second dummy input line LDI2, and a disconnected end SL32P of the source line SL32 is electrically connected with the second dummy output line LDO2.

INT3 is a contact point between the second dummy input line LDI2 and the source line SL32.

INT4 is a contact point between the second dummy output line LDO2 and the disconnected end SL32P of the source line SL32.

The source line SL32 and the second dummy input line LDI1, and the disconnected end SL32P of the source line SL32 and the second dummy output line LDO2 are electrically connected to each other using the laser beam.

The second dummy input line LDI2 is connected with an input terminal of the source line repair circuit 802, the second dummy output line LDO2 is connected with an output terminal of the source line repair circuit 802.

The second source driving signal Y32 of the source driver IC 600 is the input signal RCI2 of the source line repair circuit 802, the source line repair circuit 802 selects one of the outputs of the positive polarity amplifier (not shown) and the output of the negative polarity amplifier (now shown) based on the voltage level of the second source driving signal Y32, and buffers the selected output to generate the repair output signal RCO2.

The repair output signal RCO2 is supplied to the disconnected end SL32P of the second source line SL32.

While the present invention has been particularly shown and described with reference to exemplary embodiments thereof, it will be understood by those of ordinary skill in the art that various changes in form and details may be made therein without departing from the spirit and scope of the invention as defined by the appended claims and their equivalents.

As described above, the source driver circuit according to the present invention includes the source line repair circuit that has the same polarity type of amplifier as an amplifier constituting the buffer unit. Therefore, the source driver circuit may safely provide the source driving signal of the source driver IC to the disconnected source line when at least one of the source lines of the liquid crystal panel is disconnected.

Consequently, the yield of producing the liquid crystal panel may be improved.

What is claimed is:

1. A source line repair circuit comprising:

a comparator configured to compare a source driving signal with a common voltage signal to output a selection signal, the selection signal having a first level when the source driving signal is higher than the common voltage signal, the selection signal having a second level when the source driving signal is lower than the common voltage signal, and the source driving signal corresponding to a disconnected source line of a liquid crystal display device;

an amplifying circuit configured to amplify the source driving signal to output a first amplified signal and a second amplified signal; and a selection circuit configured to select one of the first and second amplified signals from the amplifying circuit in response to the selection signal to output the selected amplified signal to the disconnected source line.

2. The source line repair circuit of claim 1, wherein the amplifying circuit comprises:

a positive polarity amplifier configured to amplify the source driving signal to generate the first amplified signal; and a negative polarity amplifier configured to amplify the source driving signal to generate the second amplified signal.

3. The source line repair circuit of claim 2, wherein the voltage gains of the positive polarity amplifier and the negative polarity amplifier are substantially equal to 1.

4. The source line repair circuit of claim 1, wherein the selection circuit comprises:

an inverter configured to invert the selection signal;

a first transmission gate configured to receive the first amplified signal and to output the first amplified signal in response to the first level of the selection signal and the inverted selection signal having the first level; and a second transmission gate configured to receive the second amplified signal and to output the second amplified signal in response to the second level of the selection signal and the inverted selection signal having the second level.

5. A source driver circuit of a liquid crystal display device, the source driver circuit comprising:

a shift register for receiving a horizontal clock signal having a given frequency and a shift signal, the shift register being configured to generate a pulse signal every given number of clocks in response to the horizontal clock signal, and configured to generate a carry-out signal every given number of shift signals;

a latch unit for receiving input data, the latch unit being configured to latch the input data in response to the pulse signal and to output the input data in response to a load signal;

a digital-to-analog (D/A) converter unit for receiving reference gray scale voltages to generate a plurality of gray scale voltages in response to the input data output from the latch unit based on the reference gray scale voltages;

a buffer unit including a positive polarity amplifier and a negative polarity amplifier, the buffer unit buffering the gray scale voltages to output the buffered gray scale voltages to respective corresponding source lines; and at least one source line repair circuit for receiving and comparing a common voltage signal and buffered gray scale voltages corresponding to a disconnected source line, the at least one source line repair circuit being configured to select an amplifier having a same polarity type as a polarity type of an amplifier in the buffer unit to provide an output signal of the selected amplifier to the disconnected source line.

6. The source driver circuit of claim 5, further including a level shifter for raising a voltage level of an output signal of the latch unit between latch unit and D/A converter unit.

7. The source driver circuit of claim 5, further including a switch unit to transmit an output signal of the buffer unit to the corresponding source lines in response to the load signal.

8. The source driver circuit of claim 5, wherein the source driver circuit has two source line repair circuits.

9. The source driver circuit of claim 5, wherein the carry-out signal generated by the shift register is inputted to a subsequent shift register.

10. The source driver circuit of claim 5, further including a common voltage generating circuit configured to receive a high level voltage signal and a low level voltage signal, and configured to generate the common voltage signal having an intermediate voltage level between the high level voltage signal and the low level voltage signal.

11. The source driver circuit of claim 10, wherein the high level voltage signal is a positive first power supply voltage and the low level voltage signal has a ground voltage level.

12. The source driver circuit of claim 10, wherein the high level voltage of a first plurality of reference gray scale voltages is used for the high level voltage signal, and the low level voltage of a second plurality of reference gray scale voltages is used for the low level voltage signal, and the first and second plurality of reference gray scale voltages have a symmetric voltage level with respect to a ½ voltage level of the first power supply voltage.

13. The source driver circuit of claim 10, wherein the common voltage generating circuit comprises:

a first buffer configured to buffer the high level voltage signal;

a second buffer configured to buffer the low level voltage signal; and a first resistor and a second resistor serially connected between an output terminal of the first buffer and an output terminal of the second buffer, the common voltage signal being output from a connected node between the first resistor and the second resistor.

14. The source driver circuit of claim 10, wherein the common voltage generating circuit comprises:

a first buffer configured to buffer the high level voltage signal;

a second buffer configured to buffer the low level voltage signal; and a first capacitor and a second capacitor serially connected between an output terminal of the first buffer and an output terminal of the second buffer, the common voltage signal being output from a connected node between the first capacitor and the second capacitor.

15. A liquid crystal display device comprising:

a liquid crystal display panel configured to display an image, the liquid crystal display panel including a plurality of source lines, a plurality of the gate lines substantially orthogonally arranged with respect to the source lines, at least one dummy input line, and at least one dummy output line;

a gate driver circuit configured to generate a gate driving signal; and a source driver circuit including a plurality of source driver integrated circuits (ICs), each of the source driver ICs having a buffer circuit and at least one source line repair circuit, the buffer circuit generating a source driving signal and having a positive polarity amplifier and a negative polarity amplifier, and the at least one source line repair circuit being configured to receive and compare a common voltage signal and the source driving signal corresponding to the disconnected source line and via the dummy input line, and being configured to select an amplifier having a same polarity type as a polarity type of an amplifier is the buffer unit in response to the source driving signal to provide an output signal of the selected amplifier to the disconnected source line via the dummy output line.

16. The liquid crystal display device of claim 15, wherein the source driver ICs include two source line repair circuits.

17. The liquid crystal display device of claim 15, wherein when at least one source line of the source lines is disconnected, a dummy input line and a disconnected source line, and a dummy output line and the disconnected source line, are electrically connected to each other using a laser beam.

18. The liquid crystal display device of claim 15, wherein when first and second source lines of the source lines are disconnected, the first source line disposed at a first region with respect to a center line of the liquid crystal display panel provides the source driving signal to the disconnected first source line using a source line repair circuit in a source driver IC disposed at a first end of the source driver circuit, and the second source line disposed at a second region with respect to the center line of the liquid crystal display panel provides the source driving signal to the disconnected second source line using a source line repair circuit in a source driver IC disposed at a second end of the source driver circuit.

19. A method of repairing a source line, comprising:

comparing a source driving signal with a common voltage signal to output a selection signal, the selection signal having a first level when the source driving signal is higher than the common voltage signal, the selection signal having a second level when the source driving signal is lower than the common voltage signal, and the source driving signal corresponding to a disconnected source line of a liquid crystal display device;

amplifying the source driving signal to output a first amplified signal and a second amplified signal; and selecting one of the first and second amplified signals in response to the selection signal to output the selected amplified signal to the disconnected source line.

* * * * *